US005567481A

United States Patent [19]

Yu et al.

[11] Patent Number: 5,567,481

[45] Date of Patent: *Oct. 22, 1996

[54] APPARATUS AND METHOD FOR COATING AND DRYING PAPER SHEETS

[76] Inventors: Tom Y. Yu, 8364 Reservoir Rd., Fulton, Md. 20759; Randy L. Hendrickson, 35 Beaver Dam Dr., Seaford, Del. 19973

[ * ] Notice: The term of this patent shall not extend beyond the expiration date of Pat. No. 5,457,283.

[21] Appl. No.: 377,612

[22] Filed: Jan. 25, 1995

Related U.S. Application Data

[63] Continuation-in-part of Ser. No. 285,209, Aug. 3, 1994, Pat. No. 5,457,283, which is a continuation of Ser. No. 209,886, Mar. 14, 1994, abandoned, which is a continuation of Ser. No. 33,350, Mar. 18; 1993, abandoned.

[30] Foreign Application Priority Data

Nov. 19, 1992 [CN] China ..... 92241262.6

[51] Int. Cl.[6] ..... B05D 1/28

[52] U.S. Cl. ..... 427/428; 427/372.2; 118/58; 118/62; 118/231; 118/244; 118/249

[58] Field of Search ..... 427/428, 372.2; 118/58, 62, 231, 244, 249

[56] References Cited

U.S. PATENT DOCUMENTS 151,596 6/1874 Jaeger .
1,633,960 6/1927 Staege .
1,689,743 10/1928 Mullen .
1,701,878 2/1929 Freegard .
2,155,083 4/1939 Drewsen .
3,453,744 7/1969 Yagelowich .
3,530,823 9/1970 Giordano ..... 118/12
3,535,140 10/1970 Busch .
3,618,226 11/1971 Goldenberg et al. .
3,685,167 8/1972 Loveday et al. .
3,800,432 4/1974 Miyata et al. ..... 34/239
4,998,359 3/1991 Rhymer et al. .
5,457,283 10/1995 Yu et al. ..... 118/62

*Primary Examiner*—Shrive Beck
*Assistant Examiner*—David M. Maiorana
*Attorney, Agent, or Firm*—Donald A. Kettlestrings

[57] ABSTRACT

Apparatus and method for coating lower surfaces of paper sheets with lacquer and drying the sheets include fans for simultaneously drying the sheets and for forcing the sheets upwardly against the lower surface of spaced-apart moving conveyer belts. The streams of air produced by the fans are directed upwardly against the paper sheets and against and through the conveyer belts, and the paper sheets are moved from a first location to a second location within the apparatus. Features provide for washing and cleaning the apparatus and for circulating the lacquer to keep the lacquer in a uniform mixed state.

24 Claims, 3 Drawing Sheets

APPARATUS AND METHOD FOR COATING AND DRYING PAPER SHEETS

CROSS-REFERENCES TO RELATED APPLICATIONS

This application is a continuation-in-part of application Ser. No. 08/285,209, filed Aug. 3, 1994, now U.S. Pat. No. 5,457,283 for Apparatus For Coating And Drying Paper Sheets, which was a continuation of application Ser. No. 08/209,886, filed Mar. 14, 1994 for Paper Sheet Coating Apparatus With Gas Streams Drying And Auxiliary Transporting System, now abandoned, which was a continuation of application Ser. No. 08/033,350 filed Mar. 18, 1993, for Paper Sheet Coating Apparatus With Gas Streams Drying And Auxiliary Transporting System, now abandoned.

BACKGROUND OF THE INVENTION

This invention relates to sheet coating and drying apparatus and more particularly to paper sheet coating and drying apparatus which uses a simple and efficient configuration for coating the lower surfaces of paper sheets with lacquer or other coating liquid and which then efficiently uses air streams created by fans to simultaneously dry the lower surfaces of the coated paper sheets while holding or supporting the paper sheets upwardly against a conveyer as the paper sheets pass through the apparatus.

When one side of paper sheets, such as photographic paper sheets, are to be coated with a liquid, such as lacquer, it is most efficient to provide the coating liquid to the paper sheets from below the paper sheets so that the lower sides of the sheets are the sides that are coated. This is true because it is more difficult and less efficient to handle and move a coating liquid in a manner relative to the sheets so that the top surfaces of the sheets are coated. Applying a coating liquid to the tops of the sheets requires more complicated mechanisms than are required for coating the lower surfaces of the sheets.

When the lower sides of sheets are coated, however, drying of the lower sides of the sheets becomes difficult with known coating and drying machines. This is because the lower, wet sides of the sheets cannot be permitted to contact a conveyer or any other structure used to transport the sheets through the machine or to eject the coated sheets from the machine until the sheets are dried.

Various types of coating machines are known for use in coating and drying paper sheets. However, none of the known machines use gas or air streams for simultaneously drying lower surfaces of the paper sheets and for supporting the paper sheets as the sheets pass through the machine. Also, known machines have not proved entirely satisfactory under all conditions of service because it is often difficult to maintain uniformity in the lacquer mixture used to coat the paper during the coating process and it is often difficult and time-consuming to clean lacquer from the internal working mechanisms of the machines.

It is, therefore, an object of the present invention to provide an apparatus and method for coating and drying paper sheets.

Another object is to provide such an apparatus and method which efficiently uses the force of air generated by fans to simultaneously dry the paper sheets and to support the paper sheets against a conveyer as the sheets are transported through the apparatus.

A further object of the invention is the provision of such an apparatus and method which recirculates lacquer or coating liquid to maintain uniformity of the lacquer or coating liquid during operation of the apparatus.

Still another object is to provide such an apparatus and method which includes a simple and expedient configuration for quickly and easily washing and cleaning internal parts of the apparatus which become covered with lacquer or other coating liquid.

Another object is to provide such an apparatus and method which coats lower sides of paper sheets, such as photographic paper sheets, and which simultaneously dries the paper sheets and supports the paper sheets by use of air streams as the sheets move through the apparatus.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects the present invention provides sheet coating and drying apparatus, comprising: first means for receiving and coating the sheet with a coating liquid and for moving the sheet to a first location; gas stream permeable sheet conveyer means positioned for receiving the sheet from the coating and moving means at the first location and for conveying the sheet in a first direction to a second location; second means in operative relationship with the conveyer means for supplying and directing gas streams between the first and second locations and from beneath and against the sheet and from beneath and through the conveyer means for pressing and holding the sheet upwardly against the conveyer means and for drying the sheet; and third means at the second location in operative relationship with the conveyer means and with the second means for receiving the sheet from the conveyer means and for ejecting the sheet from the apparatus.

The invention also provides means for washing and cleaning internal parts of the apparatus, and means are also provided for automatically circulating the lacquer or coating liquid during operation of the apparatus to maintain the lacquer or other coating liquid in a uniform state.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate a preferred embodiment of the invention and, together with the description, serve to explain the principles of the invention.

DESCRIPTION OF THE PREFERRED EMBODIMENT

Figure 1:
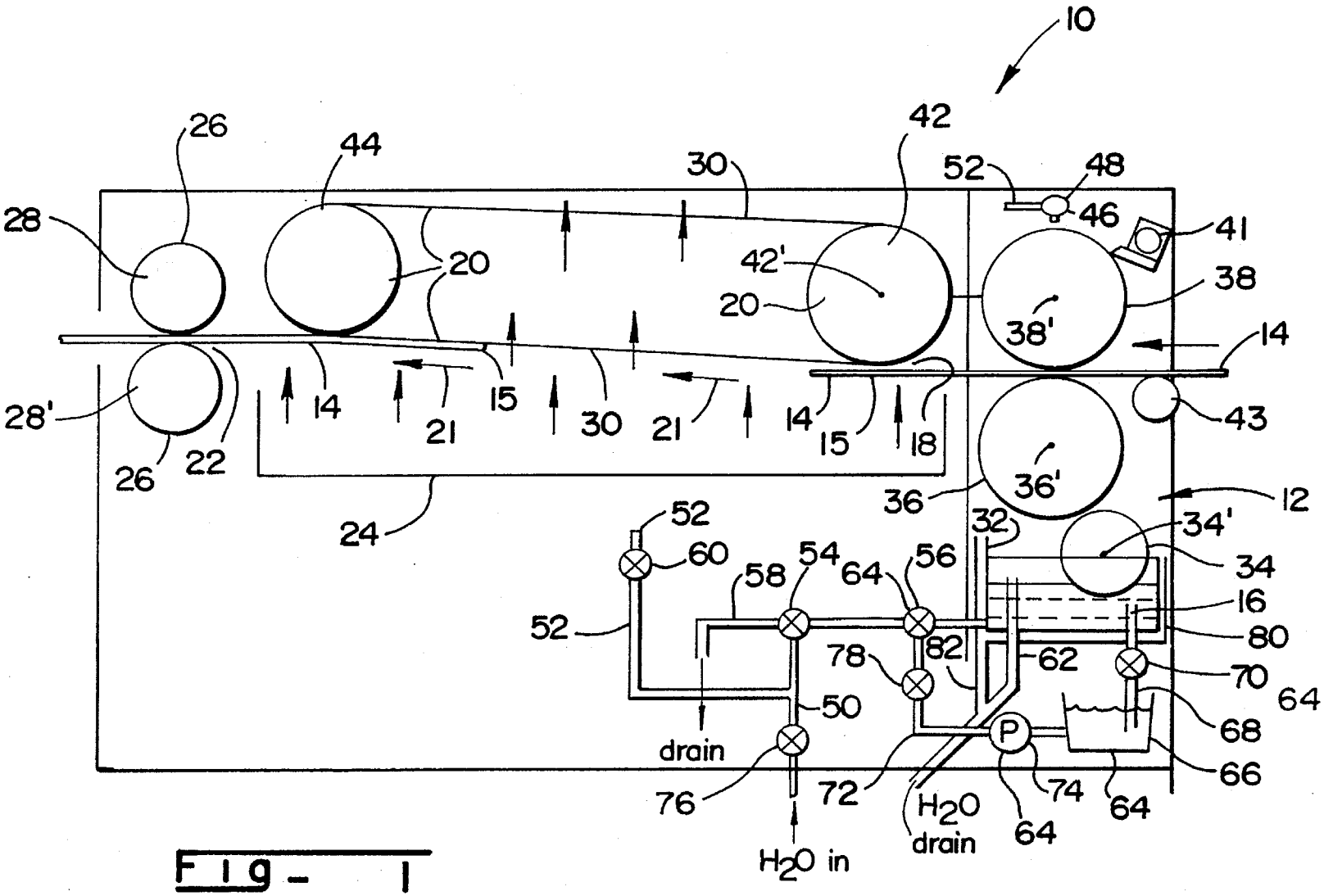
FIG. 1 is a diagrammatic side elevation view of the apparatus of this invention.

With reference now to the drawings, wherein like reference characters designate like or corresponding parts throughout the several views, there is shown sheet coating and drying apparatus 10. Apparatus 10 includes first means, generally shown at 12, for receiving and coating a lower surface 15 of a sheet or sheets 14 with a coating liquid 16 and for moving sheet 14 to a first location 18.

Gas stream permeable sheet conveyer means 20 are positioned for receiving sheet 14 from coating and moving means 12 at first location 18 and for conveying sheet 14 in a first direction 21 to a second location 22.

Fans or second means 24 are provided in operative relationship with conveyer means 20 for supplying and directing air or gas streams between first and second locations 18, 22 and from beneath and against lower surface 15 of sheet 14 and from beneath and through conveyer means 20 for pressing and holding sheet 14 upwardly against conveyer means 20 and for simultaneously drying lower surface 15 of sheet 14.

Third means 26 are provided at second location 22 for receiving sheet 14 from conveyer means 20 as the sheet is supported by air streams from fans 24 and for ejecting the sheet from apparatus 10. Third means 26 preferably includes opposed rollers 28, 28' through which sheet 14 passes, and rollers 28, 28' move sheet 14 in substantially first direction 21 to eject sheet 14 from apparatus 10.

Conveyer means 20 preferably includes a plurality of spaced-apart conveyer belts 30, and conveyer belts 30 are positioned for receiving sheet 14 against and beneath the conveyer belts.

Fans or second means 24 supply and direct air streams upwardly and substantially continuously along conveyer belts 30 between first and second locations 18, 22 to hold sheet 14 upwardly against and beneath conveyer belts 30 between locations 18 and 22.

In accordance with the invention, first means 12 include an open-topped container 32 for holding coating liquid 16. First means 12 further include a first roller 34 defining a first axis 34', and roller 34 is positioned with respect to container 32 for depositing coating liquid 16 onto roller 34 as roller 34 rotates about its axis 34'.

First means 12 further include a second roller 36 defining a second axis 36', and roller 36 is positioned to receive liquid 16 from first roller 34 as rollers 34 and 36 rotate about their respective axes. A third roller 38 defining a third axis 38' is positioned in cooperation with second roller 36 for receiving sheet 14 between rollers 36 and 38. Means 40 (FIG. 2) are provided which are connected with rollers 34, 36 and 38 for turning the rollers about their respective axes.

A scraper or squeegee 41 positioned against roller 38 scrapes the lacquer or coating liquid on roller 38 and a supporting roller 43 can be provided for assisting the feeding of sheets 14 into apparatus 10.

Conveyer means 20 preferably include a first, driving wheel 42 defining a fourth axis 42'. Conveyer means 20 further include means 40 connected to driving wheel 42 for turning the driving wheel about its axis. Conveyer means 20 further include a second, idler wheel 44, and conveyer belts 30 are connected between driving wheel 42 and idler wheel 44. Of course, wheel 44 could be a driving wheel and wheel 42 could be an idler wheel.

In accordance with the invention, apparatus 10 also includes means generally indicated at 46 for selectively washing and cleaning rollers 34, 36, 38 and container 32. Washing and cleaning means 46 include means 48 positioned adjacent to rollers 34, 36, 38 for spraying a cleaning liquid, such as water, over and around the rollers. Cleaning means 46 also include a cleaning liquid supply conduit 50 and a first conduit 52 connected between supply conduit 50 and spraying means 48 for passing the cleaning liquid to spraying means 48 from supply conduit 50. Cleaning means 46 further include a first valve 54 and a second valve 56 connected to supply conduit 50 and to container 32 for controlling flow of the cleaning liquid through supply conduit 50 to container 32.

In accordance with the invention, washing and cleaning means 46 further include a first drain conduit 58 connected to valve 54, a third valve 60 connected to first conduit 52 for controlling flow of the cleaning liquid through conduit 52 to spraying means 48, and a second drain conduit 62 connected to container 32 for draining the cleaning liquid from container 32 when the cleaning liquid level within container 32 reaches a first predetermined level.

Apparatus 10 preferably also includes fourth means generally shown at 64 connected with container 32 for automatically removing coating liquid 16 from container 32 and for returning the coating liquid to container 32 to maintain the coating liquid in a state of recirculation through container 32.

In accordance with the invention, fourth means 64 include a reservoir 66 for holding coating liquid 16. A third drain conduit 68 is connected between container 32 and reservoir 66 for draining coating liquid 16 from container 32 to reservoir 66 when the coating liquid reaches a predetermined level within container 32. A fourth valve 70 is connected to drain conduit 68 for controlling the flow of coating liquid through drain conduit 68. A fourth conduit or pipe 72 is connected between reservoir 66 and valve 56, and a liquid pump 74 is connected to fourth conduit 72 for pumping coating liquid 16 from reservoir 66, through conduit 72, through valve 56 and into container 32 so that coating liquid 16 can be recirculated into, through and out of container 32 to maintain the coating liquid in a uniformly mixed condition.

Drain conduit 62 is positioned in container 32 to act as an overflow drain so that cleaning liquid can approach the upper margins of container 32 before being drained from the container. In this manner, container 32 can be thoroughly cleaned.

A cleaning liquid or water supply valve 76 is provided within supply conduit 59 for controlling the supply of water or cleaning liquid to apparatus 10. Also, a safety valve 78 is preferably connected to conduit 72 and between pump 74 and valve 56 for controlling the flow of coating liquid 16.

Valves 54, 56 are each conventional two-way valves which direct liquid flow in ode of two directions through the valves depending upon the positions of the valves. Valves 60, 70, 76 and 78 are each conventional on/off valves.

In accordance with the invention, apparatus 10 also includes control means 40 (FIG. 2) connected to rollers 34, 36, 38, to conveyer means 20, to fans or second means 24, to valves 54, 56, 60, 70, 76 and 78 and to pump 74 for controlling the operation of apparatus 10. Controlling means 40 may be a microprocessor, for example, and a flow diagram showing operation of apparatus 10 and the microprocessor is illustrated in FIG. 3.

Coating liquid 16 is preferably a water-based lacquer, and the cleaning liquid used is preferably water. However, it should be understood that this invention contemplates the use of different coating liquids and different cleaning liquids.

In operation and use of apparatus 10, paper sheets 14, such as photographic paper sheets, are fed over supporting roller 43 and between rollers 36, 38. Lacquer or other coating liquid 16 is transferred from roller 34 as it rotates about its axis 34' to roller 36 as it rotates about its axis 36'. The lacquer or other coating liquid is applied from roller 36 to lower surfaces 15 of sheets 14 as the sheets pass separately through and between rollers 36, 38.

As sheet 14 emerges from between rollers 36, 38, the force of air streams directed upwardly by fans 24 against lower surface 15 of sheet 14 acts to force sheet 14 upwardly and against conveyer belts 30. The upwardly directed air streams are provided continuously along the path of travel of sheet 14 between locations 18 and 22 so that sheet 14 is constantly forced upwardly against conveyer belts 30 as the belts move in direction 21.

The upward force of air from fans 24 also continues to support sheet 14 for the short distance between conveyer belts 30 as they pass around wheel 44 and second location 22. As a result, each sheet 14 is directed between driven rollers 28, 28' which engage sheet 14 and continue to transport the sheet substantially in direction 21 to eject the sheet from apparatus 10. A collector or other support, not shown, can be used to receive and collect the ejected sheets.

As sheets 14 move along beneath conveyer belts 30, the air streams generated by fans 24 simultaneously support sheets 14 and dry lower surfaces 15 of the sheets as the sheets pass from first location 18 to second location 22.

This invention specifically contemplates the use of water soluble lacquer 16 to coat photographic paper sheets 14. Because of the nature of the lacquer and because additional small amounts of water may be added to the lacquer as a result of the washing and cleaning process, which will be explained hereinafter, it is advantageous to circulate lacquer 16 during operation of apparatus 10 to maintain the lacquer in a uniformly mixed condition. This mixing is accomplished by use of reservoir 66 in cooperation with liquid pump 74. During operation of apparatus 10, controlling means 40 is programmed or otherwise configured to open valves 70, 78 and to position two-way valve 56 so that lacquer 16 is drained from container 32 through drain conduit 68 and through valve 70 into reservoir 66. Pump 74 then pumps the lacquer from reservoir 66 through conduit or pipe 72, through valve 78 and through valve 56 into container 32. This circulation of lacquer can continue during operation of apparatus 10, or controlling means 40 can be programmed to circulate the lacquer in the manner described for predetermined periods of time.

During usage of apparatus 10, lacquer can build up and collect on rollers 34, 36 and 38 and within container 32. In order to maintain the rollers and container 32 in optimum operating condition, it is desirable to wash and clean the rollers and the container to prevent the undesirable build-up of lacquer. This invention provides a simple and efficient configuration for washing and cleaning the rollers and the container without requiring the cumbersome and time-consuming removal of the rollers or the container from the apparatus.

The washing and cleaning process is preferably controlled by control means 40 (FIG. 2) which includes motor 47. Pump 74, motor 47 and fans 24 are turned off and valve 70 is closed to permit lacquer or other coating liquid 16 located within container 32 to drain through valve 56, through valve 78, through pump 74 and into reservoir 66. Container 32 is configured so that the lowest portion 33 (FIG. 2) of the container permits substantially all of the lacquer to drain from container 32 and into reservoir 66.

After a predetermined period of time sufficient to allow container 32 to be completely drained of lacquer, controlling means 40 then acts to close valve 78 and to open valves 60 and 76 so that water or other cleaning liquid passes through valve 76, through conduit 52, through valve 60 and out through spraying nozzles 48 for a predetermined period of time. Motor 47 will also be turned on high speed. Nozzles 48 are positioned to direct steams of water or other cleaning liquid over, against and around rollers 34, 36 and 38 as the rollers are turned at high speed by motor 47.

Controlling means 40 also act to position two-way valves 54 and 56 so that water or other cleaning liquid will flow from supply conduit 50, through valves 54, 56 and into container 32. The water or other cleaning liquid will rise upwardly within container 32 to clean lacquer from the interior of the container, and the water or other cleaning liquid will drain from container 32 through overflow drain line 62 when the water or other cleaning liquid reaches a predetermined level within container 32.

This washing step will continue for a predetermined time and then controlling means 40 will act to close valves 60 and 76 and valve 54 will be repositioned to permit container 32 to drain through drain pipe 58. Valve 54 will then be repositioned by controlling means 40 and valves 60, 76 will be opened to allow another washing to take place. This washing and draining cycle can be repeated as determined by controlling means 40.

Any overflow of water or cleaning liquid from container 32 and any run off from spray nozzles 48 not collected by container 32 will be collected within overflow container 80, which will be drained through drain pipe 82.

Controlling means 40 will then close valves 60 and 76 and will turn off motor 47 for a predetermined time period. Valve 76 can then be reopened and motor 47 can be turned on for a period of time to further clean container 32 and rollers 34, 36 and 38. Valve 76 will then be closed and motor 47 will be turned off.

When it is desired to apply lacquer to sheets 14, controlling means 40 will position two-way valve 54 so that water or other cleaning liquid will drain from container 32, through valve 56, through valve 54 and through drain conduit 58. This draining process will continue for a predetermined time, as determined by controller 40.

When apparatus 10 is again ready to be used to coat sheets 14, controller 40 activates motor 47 and positions two-way valve 56, opens valves 70, 78 and activates pump 74 so that lacquer or other coating liquid 16 is again circulated from reservoir 66 and through container 32, as previously described. The speed of motor 47 can also be manually controlled in a conventional manner to control the speed of sheets 14 as they move through apparatus 10.

A preferred example of a flow diagram or operating sequence for apparatus 10 and for controller 40 is shown in FIG. 3, and it is preferred that controller 40 include a microprocessor 45 and motor 47. Microprocessor 45 will be connected in a conventional manner to control action of motor 47, and microprocessor 45 will also be electrically connected in a conventional manner to control the operation of pump 74 and valves 54, 56, 60, 70, 76 and 78. Electrical control of valves and pumps is well known and is not described in detail herein. Alternatively, the operation of apparatus 10 and the control of pump 74 and valves 54, 56, 60, 70, 76 and 78 could be manually controlled. Motor 47 is connected through conventional gearing, not shown, to control movement of rollers 28, 28', 34, 36, 38, 43 and to control movement of wheels 42, 44 of conveyer belts 30.

Figure 2:
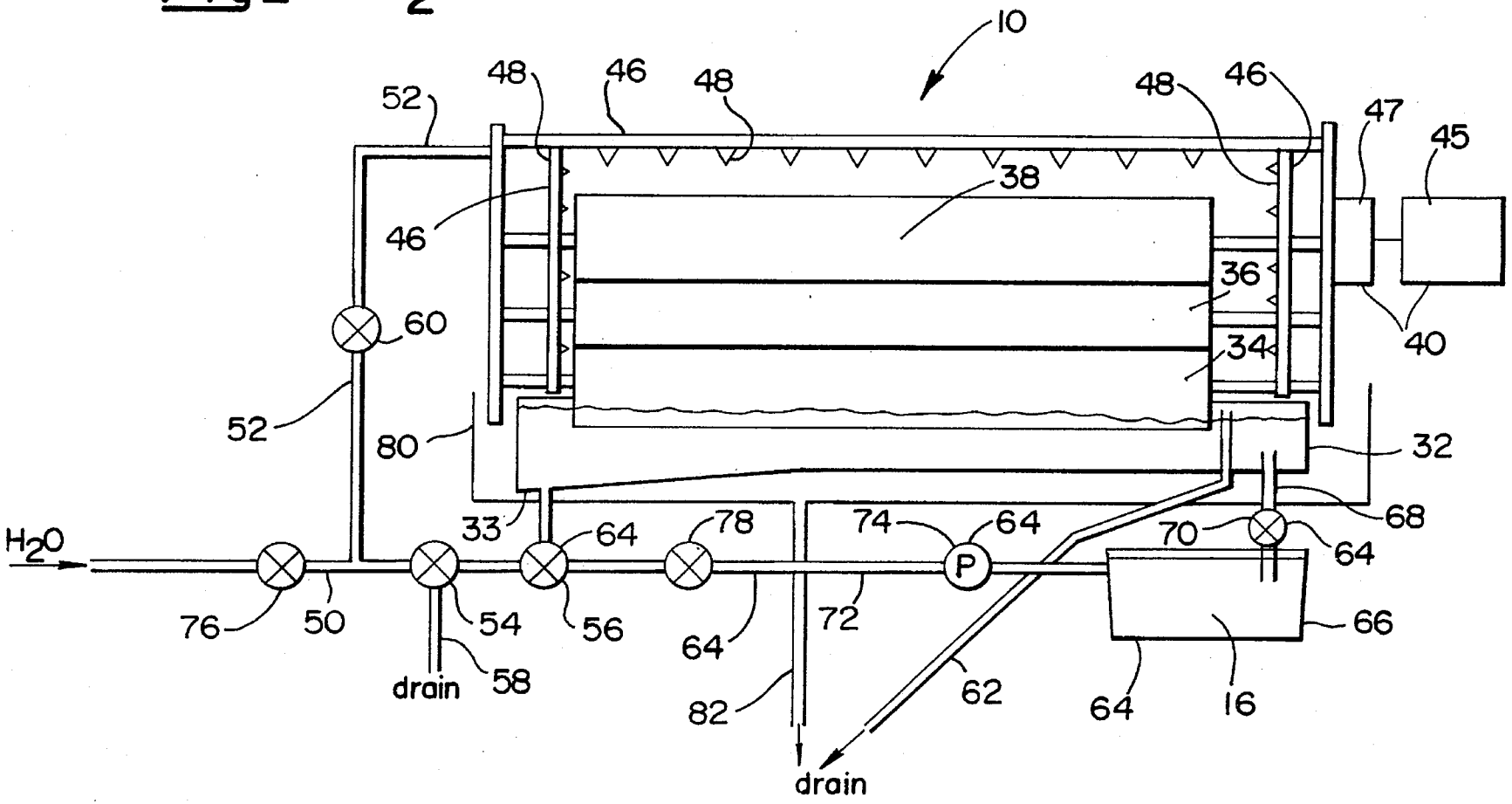
FIG. 2 is a diagrammatic end elevation view of a portion of the apparatus of this invention.
Figure 3:
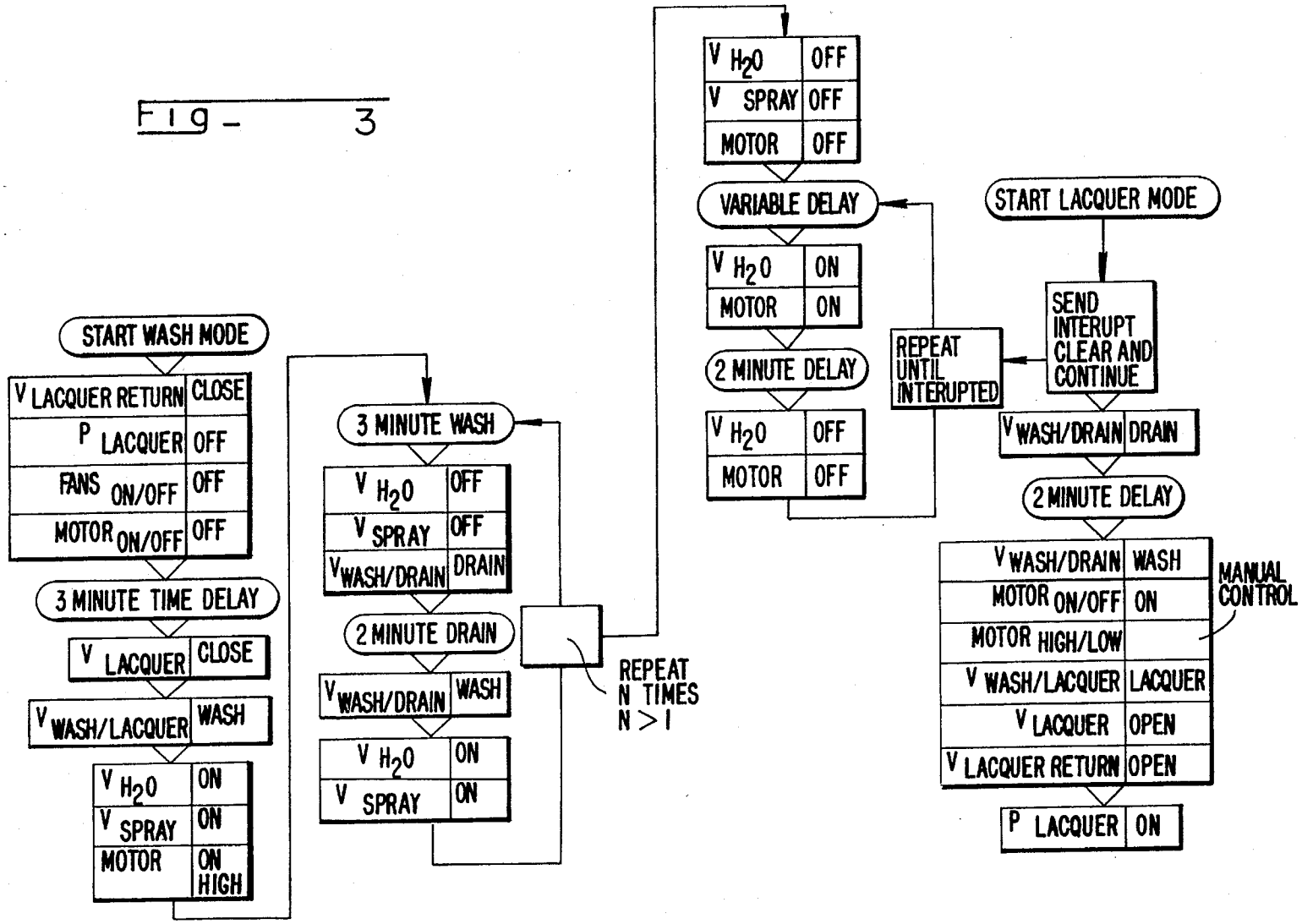
FIG. 3 is a flow diagram illustrating operation of the apparatus of this invention.

For the purpose of interpreting the flow diagram of FIG. 3, the following table identifies the elements of apparatus 10 shown in FIGS. 1 and 2 and correlates those elements with the terms used in FIG. 3.

| Controlled Elements | |
|---|---|
| V Lacquer return = | valve 70 |
| V $H_2O$ = | valve 76 |
| V Wash/drain = | valve 54 |
| P Lacquer = | pump 74 |
| V Lacquer = | valve 78 |
| V Wash/lacquer = | valve 56 |
| V Spray = | valve 60 |
| Fans on/off = | fans 24 |
| Motor high/low = | motor 47 |
| Motor on/off = | motor 47 |

This invention provides for an efficient apparatus and method for simultaneously coating lower surfaces of paper sheets, such as photographic paper sheets, with lacquer and drying the sheets with fans wherein the fans simultaneously dry the paper sheets and cooperate with conveyer belts to support the sheets and transport the sheets through the apparatus. The invention also provides a configuration for circulating the lacquer or cleaning liquid to keep the lacquer in a uniform mixed state, and structure is provided for quickly and easily washing the apparatus without requiring any disassembly.

The invention in its broader aspects is not limited to the specific details shown and described, and departures may be made from such details without departing from the principles of the invention and without sacrificing its chief advantages.

What is claimed is:

1. A method of coating and drying a sheet, comprising the steps of:

coating only a lower surface of said sheet with a coating liquid;

moving said coated sheet to a first location substantially beneath gas stream permeable conveyer belts having lower sides;

moving said conveyer belts from said first location to a second location in a first direction;

directing gas streams upwardly against said lower surface of said sheet and against and through said conveyer belts as said belts move in said first direction from said first location to said second location to dry said sheet and to press and hold said sheet upwardly against said lower sides of said conveyer belts;

moving said sheet from said first location to said second location in said first direction as said sheet is held against said lower sides of said conveyer belts by said gas streams;

ejecting said dried sheet from said second location;

wherein said step of coating said sheet further includes the steps of:

providing a container holding said coating liquid, rotating a first roller through said coating liquid in said container, collecting said coating liquid onto said first roller, rotating a second roller to receive said coating liquid from said first roller, rotating a third roller, passing said sheet between said second and third rollers to said first location, and transferring said coating liquid from said second roller to a lower surface of said sheet as said sheet passes between said second and third rollers.

2. A method as in claim 1 wherein said dried sheet is ejected from said second location as said sheet moves in substantially said first direction.

3. A method as in claim 1 further including the steps of:

providing a reservoir for receiving said coating liquid drained through a drain line from said container;

pumping said coating liquid from said reservoir to said container; and draining said coating liquid from said container to said reservoir, whereby said coating liquid is circulated through said container to keep said coating liquid substantially uniformly mixed.

4. A method as in claim 3 further including the steps of:

draining said coating liquid substantially completely from said container to said reservoir;

closing said drain line from said container to said reservoir to prevent further drainage from said container to said reservoir;

providing spray nozzles adjacent to and directed toward said rollers and above said container;

introducing a cleaning liquid through said nozzles and against said rollers to wash and clean said rollers of said coating liquid;

introducing said cleaning liquid directly into said container to wash and clean said container of said coating liquid;

collecting said cleaning liquid from said nozzles in said container; and draining said cleaning liquid from said container.

5. Sheet coating and drying apparatus, comprising:

first means for receiving and coating only a lower surface of said sheet with a coating liquid and for moving said sheet to a first location;

gas stream permeable sheet conveyer means positioned for receiving said sheet from said coating and moving means at said first location and for conveying said sheet in a first direction to a second location;

second means in operative relationship with said conveyer means for supplying and directing gas streams between said first and second locations and from beneath and against said lower surface of said sheet and from beneath and through said conveyer means for pressing and holding said sheet upwardly against said conveyer means and for drying said sheet; and third means at said second location in operative relationship with said conveyer means and with said second means for receiving said sheet from said conveyer means and for ejecting said sheet from said apparatus.

6. Apparatus as in claim 5 wherein said third means is operative to move said sheet in substantially said first direction.

7. Apparatus as in claim 5 wherein said conveyer means includes a plurality of spaced-apart conveyer belts.

8. Apparatus as in claim 7 wherein said conveyer belts are positioned for receiving said sheet against and beneath said conveyer belts.

9. Apparatus as in claim 8 wherein said second means supplies and directs said gas streams substantially continuously along said conveyer belts between said first and second locations to hold said sheet upwardly against and beneath said conveyer belts between said first and second locations.

10. Apparatus as in claim 9 wherein said first means include:

a container for holding said coating liquid;

a first roller defining a first axis, said roller positioned in operative relationship with said container for depositing said liquid onto said first roller as said first roller rotates about said first axis;

a second roller defining a second axis, said second roller positioned to receive said liquid from said first roller as said first and second rollers rotate about said first and second axes;

a third roller defining a third axis, said third roller positioned in operative relationship with said second roller for receiving said sheet therebetween; and means in operative relationship with said rollers for turning said rollers about said axes.

11. Apparatus as in claim 10 wherein said conveyer means include:

a first, driving wheel defining a fourth axis;

means in operative relationship for turning said driving wheel about said fourth axis;

a second, idler wheel; and said conveyer belts connected between said driving wheel and said idler wheel.

12. Apparatus as in claim 10 further including means in operative relationship with said rollers and with said container for selectively washing and cleaning said rollers and said container.

13. Apparatus as in claim 12 wherein said washing and cleaning means include:

means positioned adjacent to said rollers for spraying a cleaning liquid over and around said rollers;

a cleaning liquid supply conduit;

a first conduit connected between said supply conduit and said spraying means for passing said cleaning liquid to said spraying means from said supply conduit; and first and second valve means connected in operative relationship with said supply conduit and with said container for controlling flow of said cleaning liquid through said supply conduit to said container.

14. Apparatus as in claim 13 wherein said washing and cleaning means further include:

a first drain conduit connected to said first valve means;

third valve means connected in operative relationship with said first conduit for controlling flow of said cleaning liquid through said first conduit to said spraying means; and a second drain conduit connected to said container for draining said cleaning liquid from said container when said cleaning liquid level within said container reaches a first predetermined level.

15. Apparatus as in claim 14 further including fourth means connected in operative relationship with said container for automatically removing said coating liquid from said container and returning said coating liquid to said container to maintain said coating liquid in a state of recirculation through said container.

16. Apparatus as in claim 15 wherein said fourth means include:

a reservoir for holding said coating liquid;

a third drain conduit connected between said container and said reservoir for draining said coating liquid from said container to said reservoir when said coating liquid reaches a second predetermined level within said container;

fourth valve means connected in operative relationship with said third drain conduit for controlling liquid flow through said third drain conduit;

a fourth conduit connected between said reservoir and said second valve means; and liquid pump means connected in operative relationship with said fourth conduit for pumping said coating liquid from said reservoir, through said fourth conduit, through said second valve means, and into said container, whereby said coating liquid can be circulated into, through and out of said container.

17. Apparatus as in claim 16 wherein said first predetermined level is greater than said second predetermined level.

18. Apparatus as in claim 17 wherein said first and second valve means are each two-way valves which direct liquid flow in one of two directions through the valves depending upon the positions of the valves.

19. Apparatus as in claim 18 wherein said third and fourth valve means are each an on/off valve.

20. Apparatus as in claim 19 further including means in operative relationship with said rollers, said conveyer means, said second means, said valve means and said pump means for controlling operation thereof.

21. Apparatus as in claim 20 wherein said coating liquid is a water-based lacquer.

22. Apparatus as in claim 21 wherein said cleaning liquid is water.

23. Apparatus as in claim 10 further including fourth means in operative relationship with said container for automatically removing said coating liquid from said container and returning said coating liquid to said container to maintain said coating liquid in a state of recirculation through said container.

24. Apparatus as in claim 23 wherein said fourth means include:

a reservoir for holding said coating liquid;

a drain conduit connected between said container and said reservoir for draining said coating liquid from said container to said reservoir when said coating liquid reaches a predetermined level within said container;

a first valve connected in operative relationship with said drain conduit for controlling liquid flow through said drain conduit;

a pipe connected between said reservoir and said container;

a second valve connected in operative relationship with said pipe for controlling liquid flow through said pipe; and a liquid pump connected in operative relationship with said pipe for pumping said coating liquid from said reservoir, through said pipe, through said second valve and into said container, whereby said coating liquid can be circulated through said container.

* * * * *